United States Patent [19]

Zielinski

[11] Patent Number: 4,648,306

[45] Date of Patent: Mar. 10, 1987

[54] COUNTER RECOIL MECHANISM, PREFERABLY FOR AN ARTILLERY WEAPON

[75] Inventor: Erich Zielinski, Haan, Fed. Rep. of Germany

[73] Assignee: Rheinmetall GmbH, Duesseldorf, Fed. Rep. of Germany

[21] Appl. No.: 569,982

[22] Filed: Jan. 11, 1984

[30] Foreign Application Priority Data

Jan. 22, 1983 [DE] Fed. Rep. of Germany ..... 3302039

[51] Int. Cl.[4] ..... F41F 19/14

[52] U.S. Cl. ..... 89/43.02

[58] Field of Search ..... 89/43.01, 43.02

[56] References Cited

U.S. PATENT DOCUMENTS

| | | | |
|---|---|---|---|
| 214,337 | 10/1909 | Zinck . | |
| 2,574,060 | 11/1951 | Prache | 89/43.02 |
| 4,353,285 | 10/1982 | Magnuson | 89/43.02 |

*Primary Examiner*—Stephen C. Bentley

[57] ABSTRACT

A hydropneumatic recuperator arrangement for a counterrecoil mechanism of an artillery weapon which automatically adjusts the counterrecoil force in accordance with the elevation of the gun barrel. The trunnion of the gun barrel is operatively connected to a cylinder in which a piston is slidably mounted. First and second chambers of the cylinder hold a pressurized fluid medium and the volumes of these first and second chambers vary in accordance with the elevation of the gun barrel. The second chamber of the cylinder is in fluid communication with the recuperator and adjusts its recoil force in accordance with gun barrel elevation.

3 Claims, 4 Drawing Figures

COUNTER RECOIL MECHANISM, PREFERABLY FOR AN ARTILLERY WEAPON

BACKGROUND OF THE INVENTION

The invention relates to a pneuamtic or hydro-pneumatic counter recoil mechanism for an artillery weapon.

Such mechanisms generally operate by means of an hydraulic fluid (oil) arrangement, that operates hydro-pneumatically. The counter recoil recuperator of the state of the art is not capable to adjust the counter recoil force automatically to the prevailing elevation of the gun barrel. Therefore, frequently the counter recoil force is too large with a low gun barrel elevation and/or also with small charges, so that the automatic breech block function is inhibited as a result of an insufficient recoil path.

SUMMARY OF THE INVENTION

It is an object of the invention to construct a counter recoil mechanism of the afore-described type wherein the counter recoil force automatically adjusts itself in the artillery weapon to the prevailing gun barrel elevation. With reduced gun barrel elevation and small charges the counter recoil force is automatically reduced. Thereby the recoil path is enlarged so that the automatic breech mechanism remains open for a sufficient period of time. At high gun elevations, on the other hand, the counter recoil force is not reduced. Additionally, there is avoided that the recoil velocity of the gun barrel reaches inadmissibly high values, for example for ejecting the primer or for effecting the loading function which is coupled to the recoil movement.

Thus the invention provides for an automatic adjusting arrangement for a counter recoil mechanism for a gun barrel, which adjusts the volume of the chamber containing the gas or the hydraulic medium in such a way that, at reduced gun elevation, the counter recoil force becomes smaller and thereby permits an increased recoil path and effects not such a large recoil velocity. With small charges a sufficiently long recoil path is attained, which reduces the counter recoil force which acts here as a main braking force. The stream brake force in the hydraulic recoil brake accepts, with the reduced recoil velocities produced by the small charges, only a reduced portion of the recoil brake work.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
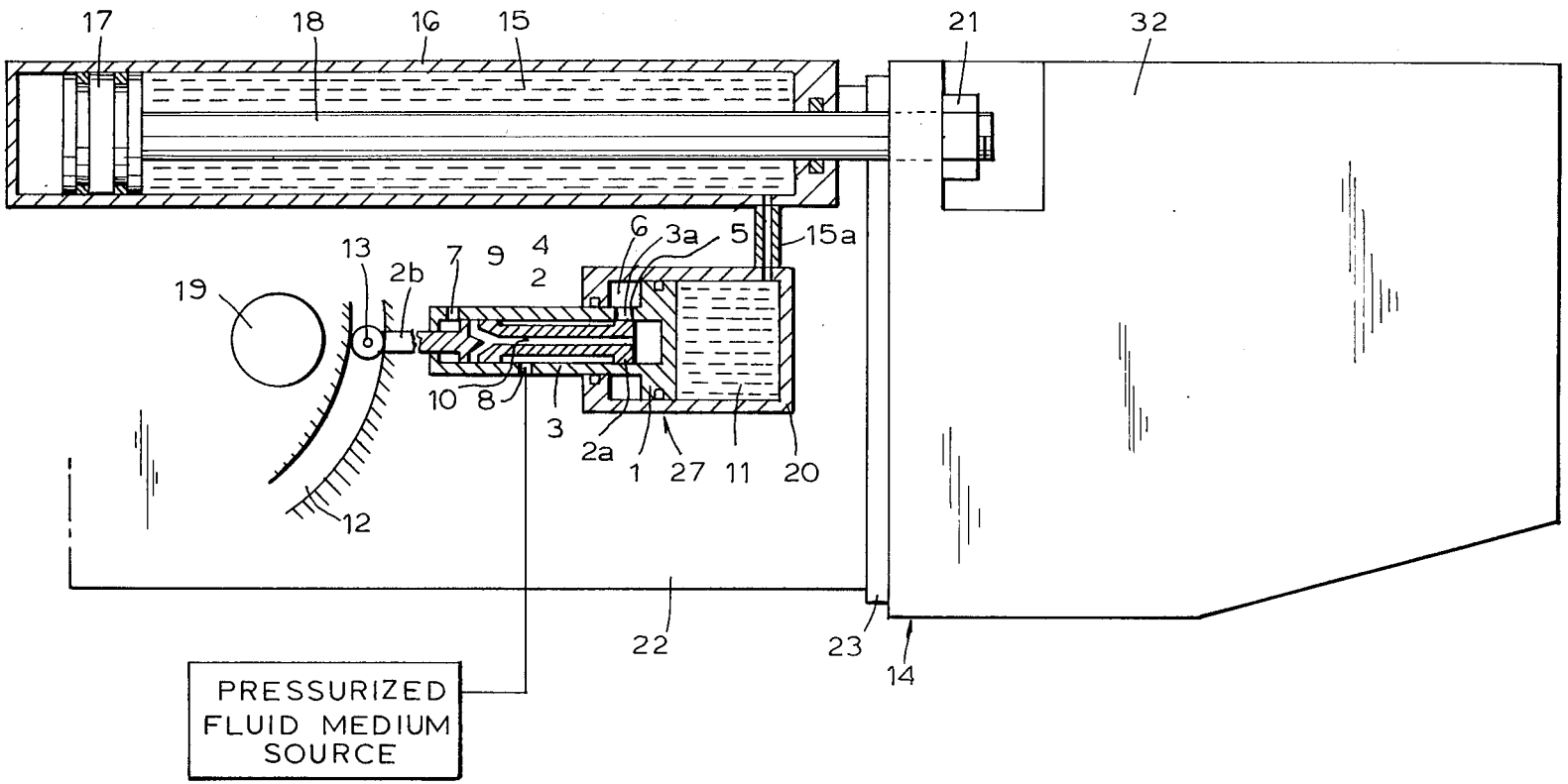
FIGS. 1 and 2 respectively illustrate schematically partially in vertical cross-section and partially in side-elevational view a first and second embodiment of a control mechanism with a control guide, respectively a slider, arranged at a pneumatic recuperator.

FIG. 1 illustrates a known pneumatic recuperator having a cylinder 16 which is mounted on the cradle frame 22 of the gun and which has in its interior a reciprocally mounted piston 17 connected to a piston rod 18 mounted in a conventional manner in the cylinder 16 by means of the usual sealing rings. This piston rod 18 is connected at its rear end by means of fastening nut 21 to a bottom member 32, which is operatively connected to the gun barrel (not illustrated). When a shot is fired in the direction towards the left in FIG. 1 the bottom member 32 travels jointly with the gun barrel backwards towards the right and causes thereby, via the piston rod 18 and piston 17, a compression of the gas in the pressure chamber 15 of the cylinder 16. Between the cradle frame 22 and the bottom member 32 a shock absorbing ring 23 is disposed to absorb excessive shock forces.

The adjusting arrangement in accordance with the invention consists of a cylinder 20, the pressure chamber 11 of which is in communication with the pressure chamber 15 of the recuperator via a conduit 15*a*. There is slidably mounted within the cylinder 20 a displacement piston 1 having a hollow smooth piston rod 3 which slidably guides the piston 1 in the cylinder 20. The conventional sealing rings are also provided in the cylinder 20. The hollow piston rod 3 has a pressure medium inlet opening 8 and a pressure medium outlet opening 7. Furthermore, a communication opening 3*a* is provided for communicating the inner chamber 6 of the cylinder 20, which is disposed behind the piston 1, either with the chamber 9 or with the conduit 10 in the inner hollow space 10 of the hollow piston rod 3. A control piston rod 2 is slidably mounted in the hollow piston rod 3, which with a control surface 2*a*, disposed between the control edges 4 and 5, covers more or less the opening 3*a* in the hollow piston rod 3. The control piston 2 furthermore includes the inner conduit 10 and the chambers 9. The free end of the control piston is formed as a roller 13 which is guidingly mounted in a curved guide groove 12 at the fixed gun carriage mount. The curved guide groove 12 is disposed in such a way that by swinging the gun cradle frame 22 and thereby also the recuperator about the trunnion 19 of the fixed gun carriage mount away from the horizontal firing position illustrated in FIG. 1 the control piston 2 is pushed into the hollow piston rod 3. Thereby the annular chamber 9 which is in communication with the inlet opening 8, is placed in communication via the opening 3*a* with the inner chamber 6 of the cylinder 20. The pressure medium than causes the displacement piston 1 to move towards the right, whereby the volume of gas in the pressure chamber 11 is made smaller (i.e. is compressed) and thereby the recoil force is increased. When the gun barrel is again swung back, then the control piston 2 is pulled towards the left by the piston rod 2*a*. Thereby the inner chamber 6 is joined via the opening 3*a* with the inner conduit 10 and thereby is also placed in communication with the pressure medium outlet opening 7. Thereby the control piston 1 can be pushed by the pneumatic medium disposed in the pressure chamber 15 via the conduit 15*a* and the pressure chamber 11, which then increases in size, toward the left, whereby the recoil force is reduced.

Figure 2:
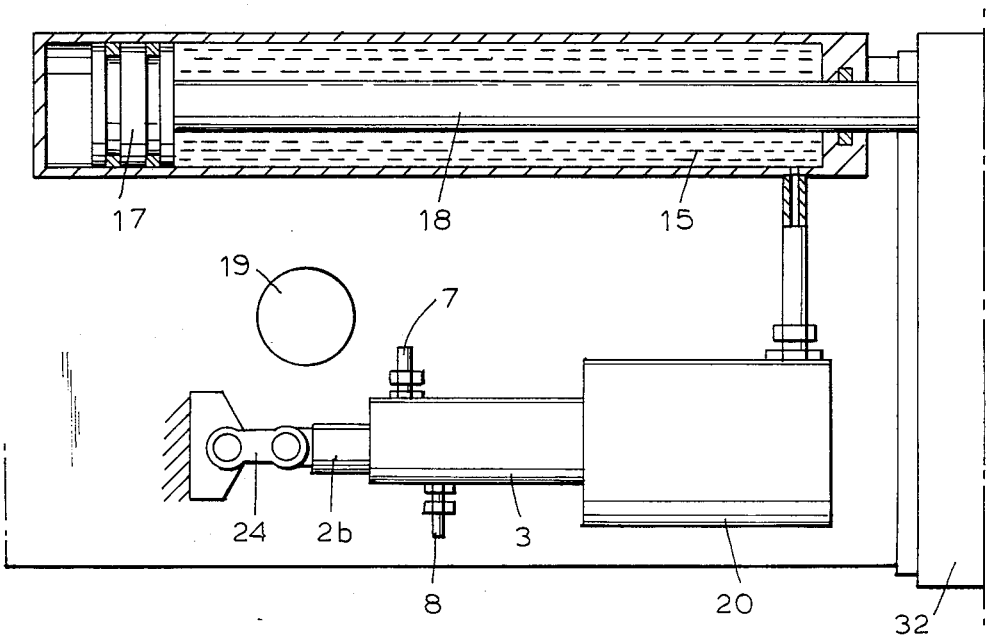

In the embodiment of FIG. 2 the piston rod 2*b* of the control piston 2 is pivotally connected via a link 24 onto that portion of the gun whose elevation is not adjustable. Consequently, a relative adjustment between the piston rod 3 and the cylinder 1 occurs during a change in elevation of the gun barrel.

Figure 4:
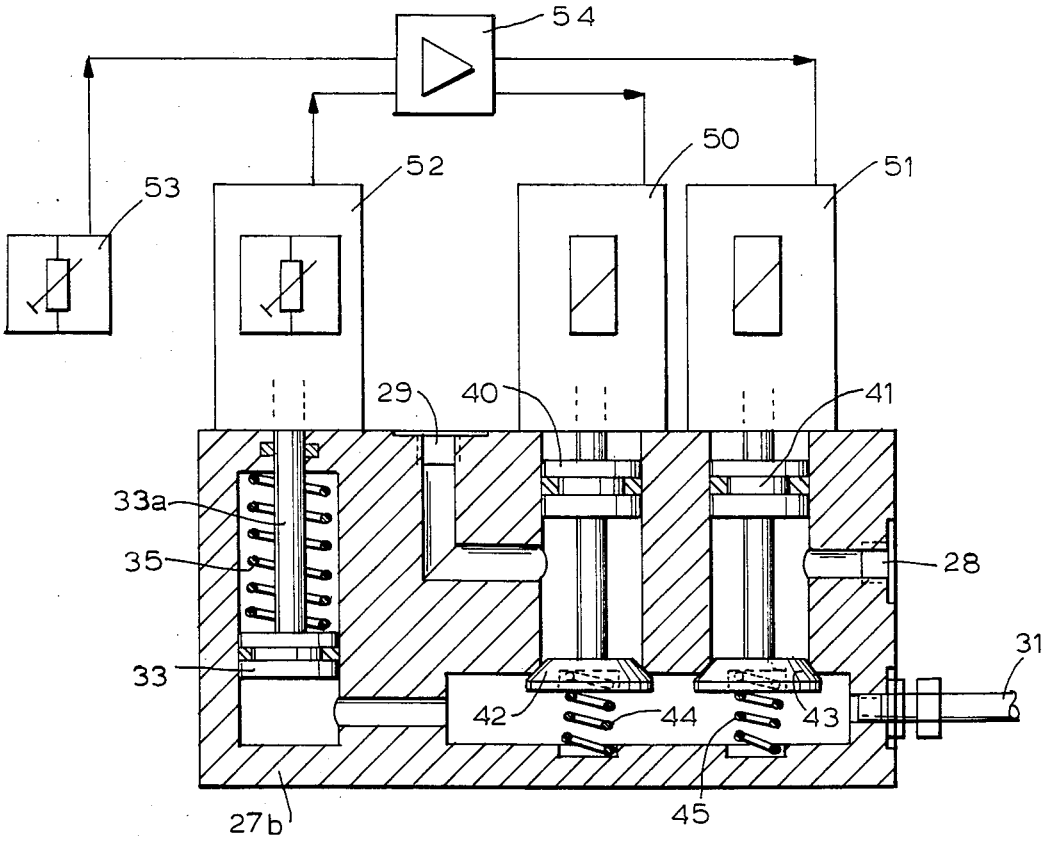
FIGS. 3 and 4 illustrate partially in vertical crosssection and partially schematically in side-elevational view two further embodiments of the control guide having mechanically, respectively electrically actuated valve seats forming part of a hydro-pneumatic recuperator.
Figure 3:
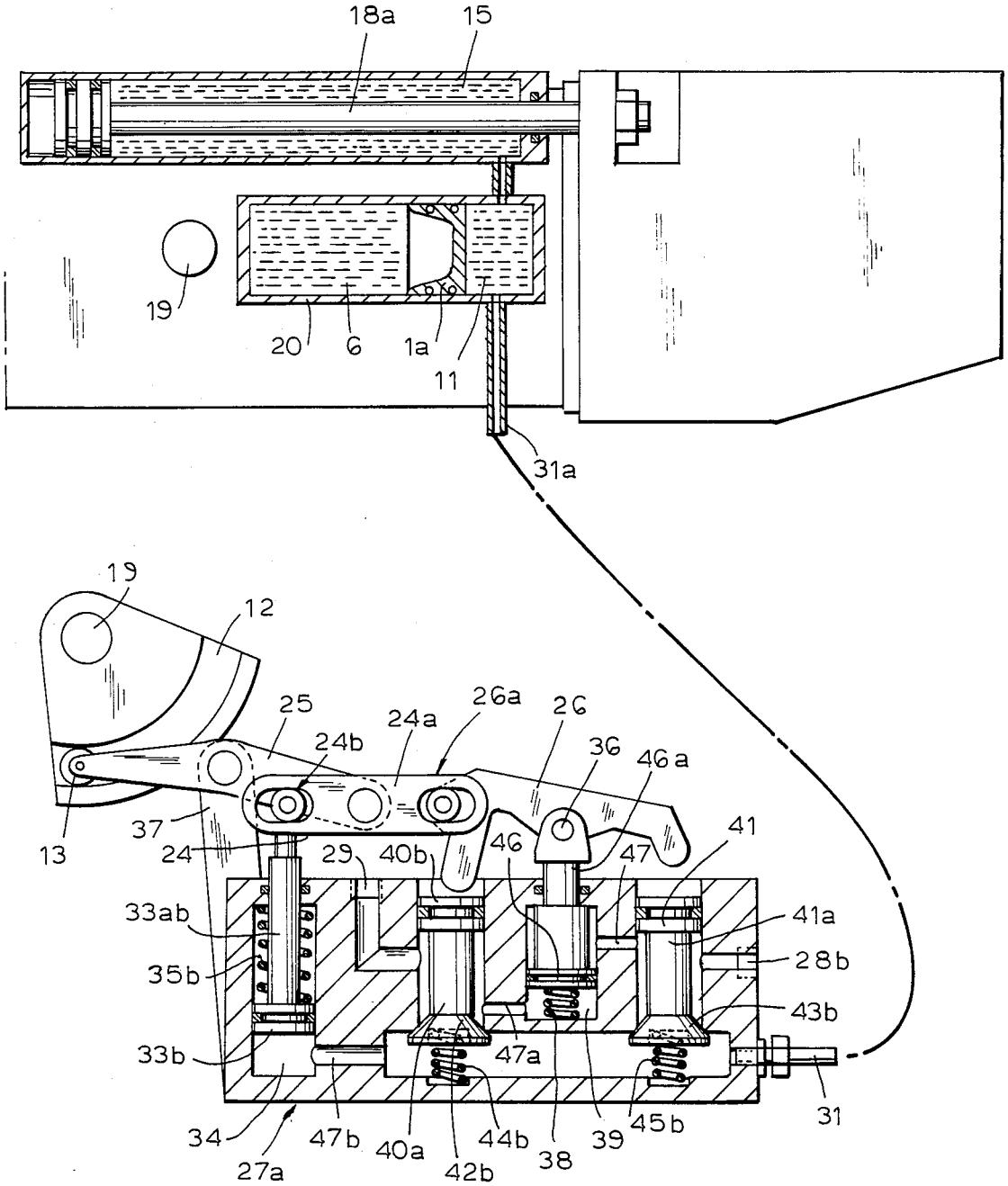

In the pneumatic recuperator of FIGS. 3 and 4 the inner chamber of the cylinder 20 is divided by means of a simple piston and piston rod 18*a* into the pressure chamber 15 and the pressure chamber 6 at the rear side of the piston 1*a*. The gas which is present in the chamber 6, can, for example, be nitrogen.

The pressure chamber 11 is joined by way of a conduit 31*a* and a communication inlet conduit 31 with the housing of a control valve 27*a* (FIG. 3), respectively 27*b* (FIG. 4). In the bores of the housing there are disposed two valves 42*b*, 43*b* which, via piston rods 40*a*, 43*b* are joined to the pistons 40*b*, 41. The valve heads of the valves 42*b*, 43*b* are held in their operative position on the valve seats in the housing by means of coil springs 44*b*, 45*b*. In the embodiment of FIG. 3 there is disposed a further cylinder chamber between the bores for the pistons 40*b*, 41, which piston chamber receives a piston 46 having a piston rod 46*a*. This piston is biased by means of a coil spring 38 abutting against its operative end, whereas at its other end it supports via a valve pivot support 36 the swingable double valve lever 26. One end of the double valve lever 26 is pivotally joined by means of a pin and slot connection 26*a* to the leg 24*a* of a balance lever 24, which is in turn pivotally joined at its other end by an other pin and slot connection 24*b* with a piston rod 33*a* of a piston 33 slidably disposed in a further piston chamber 34 of the housing 27*a*, which piston is spring-loaded by means of a coil spring 35. A control lever 25 is pivotally connected in the middle region of the balance lever 24 to the latter. A support arm 37 is fixedly secured to the housing 27*a* and pivotally supports the control lever 25, which control lever has at its other end a roller 13 which is slidable within a curved guide groove 12 forming part of the trunnion 19. There is disposed at the housing a pressure medium inlet opening 28 and a pressure medium outlet opening 29 as well as communication channels 47, 47*a*, 47*b* which communicate individual cylinder chambers to each other as shown in FIG. 3. The valve arrangement operates as follows: The valve as illustrated in FIG. 3 is in the switched off position, in which it is maintained by means of the spring 38. The valve is brought into its operative position, which means in a position in which the inlet opening 28 is pressurized, whereby the piston 46 is pressure biased at its rear side via the communication channel 47, so that the double valve lever 26 lifts off the valve head 42 from its seat in the housing 27*a*. Thereby an open communication is established between the pressure chamber 11 via the communication opening 31 past the valve head 42 towards the pressure medium outlet opening 29. If now the gun barrel is swung about the trunnion axis of the trunnion then also the control lever 25 is swung a predetermined angle (due to the special configuration of the groove 12) and via this lever by means of the balance lever 24 the double valve lever 26 is swung in such a way that with its free end it pushes down on the piston 41 and thereby lifts off the valve head 43 from its seat in the housing. The valve head 42 is then again pushed by means of the pressure spring 44 onto its seat. Now the pressure medium inlet opening 28 is in communication via the open valve head 43 with the pressure chamber 11. The return guiding of the valve double lever 26 into its starting position is effected by the pressure piston 33*b*, which is biased by the pressure coil spring 35*b*, via the balance lever 24, in view of the fact that the piston 33 is in communication via the communication channel 47*b* with the pressure medium inlet opening 31. By means of the communication channel 47*a* the adjusting of the piston 46 is made possible since the communication channel 47*a* permits the streaming of the pressure medium behind the piston towards the outlet opening 29.

For purposes of actuating electrically the control valve 27*b*, in accordance with FIG. 4, which is constructed in similar fashion as the valve in accordance with FIG. 3, the valve double lever 26 is replaced by the electromagnets 50 and 51 which are controlled by the operational amplifier 54 and the guide groove 12 and roller 13 are replaced by an elevation emitter 53 which senses the elevation of the gun barrel and emits electric pulse signals accordingly. The return guidance into the starting position results by means of the pressure measuring emitter 52, the pressure valves of which are compared in the operational amplifier 54 with the pressure values of a corresponding pressure scale, which corresponds to the prevailing gun elevation which is reported by the elevation emitter.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. An improved hydropneumatic recuperator arrangement for a counter recoil mechanism of an artillery weapon, having a first cylinder which is mounted on the cradle frame of the weapon, said first cylinder has disposed therein a first piston, and has means operatively connected to the gun barrel of the weapon, which means alternately compress and decompress a gas in a second cylinder, a second piston being disposed in said second cylinder and said second cylinder being in communication with the recuperator of the weapon, the improvement comprising in combination, said recuperator includes a first piston slidably mounted in said first cylinder, said first cylinder containg a fluid which is compressed, and then decompressed, by said first piston;

said second piston being slidably mounted in said second cylinder so as to divide said second cylinder into two variable chambers, said second cylinder being in fluid communication with said first cylinder, a first chamber of said second cylinder having a volume which automatically varies in accordance with the elevation of the gun barrel of the weapon in such way that it displaces said second piston so that with reduced gun barrel elevation, fluid pressure is applied via the first cylinder to reduce the counterrecoil force on the gun barrel and with increased gun barrel elevation acting to increase the counterrecoil force acting on the gun barrel, said second piston is a displacement piston; and control valve means operatively connected, on the one hand, to the gun barrel, and on the other hand, to said second cylinder to displace said second piston in accordance with the elevation of the gun barrel;

said control valve means coact with a first lever which is pivotally mounted on a non-movable part of the weapon, a roller is mounted at one free end of said lever, cam means disposed in the trunnion of the gun barrel and coacting with said roller so as to displace said second piston in said second cylinder in accordance with the elevation of the gun barrel; the other end of said lever being pivotally connected to a second lever, said control valve means including a housing having four bores and four piston reciprocally mounted in said four bores, said first chamber of said second cylinder being in communication with a first bore of said four bores; the piston in a second bore of said four bores pivotally supporting a third lever; said second and third levers being mutually pivotally connected to each other by a first pin-and-slot connection at one end of said third lever which one end coacts with the piston of a third bore of said four bores, whereas the other end of said third lever coacts with the piston in the first bore of said four bores; the free end of the piston of the fourth bore being also pivotally connected to said second lever by means of a pin-and-slot connection;

conduit means extending between adjoining bores in said housing and extending between the exterior of said housing and the first bore and the exterior of said housing and the third bore; said housing having a conduit for communicating the interior thereof with said first chamber of said second cylinder.

2. The improved hydropneumatic recuperator arrangement as set forth in claim 1, wherein when said third lever is in an outermost position with respect to the housing, said pistons in the first and third bores having valve plates which are seated on valve seats in the first and third bores when the third lever is in the outermost position;

a fourth spring, biasing the piston in the fourth bore, to cause said second lever to pivot in a first direction whereby when fluid pressure is applied through the conduit means between the first bore and the exterior of the housing; and the said fluid pressure counteracts said fourth spring and causes the second lever to pivot in a second direction which is opposite to said first direction.

3. The improved hydropneumatic recuperator arrangement as set forth in claim 2, wherein when said fluid pressure is applied through the conduit means, between the first bore and the exterior of the housing, fluid pressure is applied through conduit means between the first and second bores to move and maintain the piston in the second bore and third lever, pivotally mounted thereon into an operative position; and a second spring, biasing the piston in the second bore into an inoperative position, opposite to the force of the fluid pressure.

* * * * *